United States Patent [19]

McDermott

[11] 3,944,378

[45] Mar. 16, 1976

[54] ROTARY FLUID DISPLACEMENT APPARATUS WITH ORBITING TOOTHED RING MEMBER

[76] Inventor: Hugh L. McDermott, 6101 Ashcroft Ave., Minneapolis, Minn. 55424

[22] Filed: Nov. 25, 1974

[21] Appl. No.: 526,829

[52] U.S. Cl. ..... 418/60; 418/61 B

[51] Int. Cl.[2] ..... F01C 1/02; F03C 3/00; F04C 1/02

[58] Field of Search ..... 418/60, 61 B, 166

[56] References Cited

UNITED STATES PATENTS

| | | | |
|---|---|---|---|
| 2,240,874 | 5/1941 | Thomas et al. | 418/60 |
| 3,561,893 | 2/1971 | Baatrup | 418/61 B |
| 3,627,454 | 12/1971 | Goff et al. | 418/61 B |

*Primary Examiner*—John J. Vrablik

*Attorney, Agent, or Firm*—Merchant, Gould, Smith, Edell, Welter & Schmidt

[57] ABSTRACT

A casing, formed to provide fluid inlet and outlet openings and a stationary internal gear intermediate the openings, the casing journaling a rotary shaft coaxial with the internal gear. Primary and secondary rotors are fixed on the shaft in axially spaced relationship, the primary rotor having fluid passages communicating with one of the openings. A fluid transfer element is fixed on the shaft between the secondary rotor and an end of the casing, and defines a fluid passage communicating with the other casing opening. The primary rotor includes a rotary internal gear disposed near the stationary internal gear. The secondary rotor has a plurality of external tooth elements, and a cooperating ring is eccentrically mounted thereon, the ring having internal tooth elements one more in number than those of the secondary rotor. The tooth elements cooperate to define inner and outer walls of successively expanding and contracting fluid chambers. An annular member is concentrically journaled on the ring and has a pair of gears thereon which mesh with the teeth of the internal gears. A pair of valve elements are disposed between opposite ends of the ring and the primary rotor and transfer element, cooperating with these to deliver fluid from one of the casing openings to the expanding chambers and from the contracting chambers to the other casing opening.

12 Claims, 8 Drawing Figures

ROTARY FLUID DISPLACEMENT APPARATUS WITH ORBITING TOOTHED RING MEMBER

This invention relates generally to rotary fluid pressure devices such as pumps and motors, and more particularly to such devices using a gear mechanism known as a gerotor wherein a pair of cooperating internally and externally toothed members cooperate to define walls of successively expanding and contracting fluid chambers. In the present arrangement, an externally toothed member rotates on its own axis while a cooperating internally toothed ring member moves in an orbit relative to the other member with its axis moving in an orbit about the axis of the other member. In the present invention, a casing is provided having spaced apart fluid inlet and outlet openings and defining a stationary internal gear. A shaft is journaled in the casing coaxial with the internal gear and has fixedly mounted thereon primary and secondary rotors and a fluid transfer element, in axially spaced relationship. The primary rotor has an annular flange which defines a rotary internal gear axially spaced from the stationary internal gear, and further has circumferentially spaced fluid passages communicating with one of the openings in the casing. The secondary rotor is disposed intermediate the primary rotor and the fluid transfer element which has circumferentially spaced openings communicating with the other casing opening. The secondary rotor has a given number of external tooth elements which intermesh and have a sealing engagement with internal tooth elements of a ring eccentrically encompassing the secondary rotor and moving in an orbit with respect to the secondary rotor. The secondary rotor and ring cooperate to define inner and outer walls of successively expanding and contracting fluid chambers. An annular member is journaled on the ring and defines a pair of axially spaced external gears each meshing with a different one of the internal gears and moving in an orbit within the internal gears. Flow of fluid to the expanding chambers from the inlet opening and from the contracting chambers to the outlet opening is controlled by valve means cooperating with the primary rotor and transfer element. In the form of the invention herein disclosed, a pair of secondary rotors, with respective rings and annular gear-equipped members, are disposed at axially opposite sides or ends of the primary rotor, the internal tooth elements of one of the rings being angularly displaced from those of the other ring. This arrangement places the axes of the rings and their respective annular members at diametrically opposite sides of the common axis of the secondary rotors, to achieve balanced construction. Further, this arrangement provides for a single fluid inlet and a pair of fluid outlets, one for each of the secondary rotors.

DETAILED DESCRIPTION OF THE PREFERRED EMBODIMENT

Figures 1, 2:
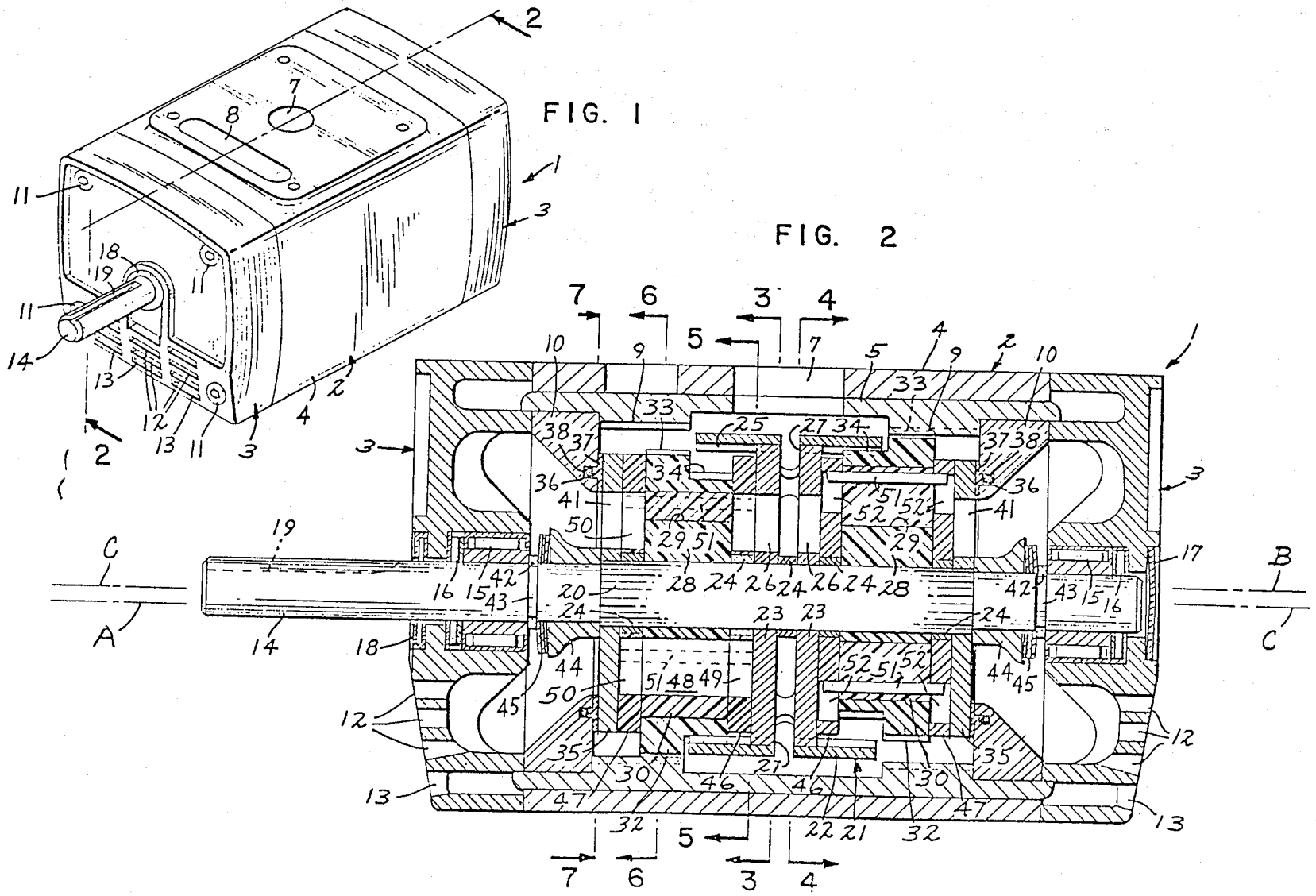
FIG. 1 is a view in perspective of a rotary fluid motor produced in accordance with the invention.
FIG. 2 is an enlarged axial section taken substantially on the line 2—2 of FIG. 1.

In the embodiment of the invention illustrated, an elongated casing 1 is shown as comprising a hollow intermediate portion 2 and opposite end caps 3. The intermediate portion 2 involves an outer housing member or shell 4, and an inner cylindrical section 5 held against rotation within the outer section 4 by means of a pair of diametrically opposed keys or like fasteners 6. Generally centrally between their ends, the casing sections 4 and 5 cooperate to define an inlet opening 7, the outer section 4 being further formed to provide a ventilation opening 8. The inner cylindrical section 5 is further formed to provide a pair of axially spaced internal stationary gears 9. A pair of annular sealing plates 10 are disposed within the opposite end portions of the inner casing section 5 between the internal stationary gears 9 and the adjacent end caps 3, the entire casing assembly being held together by machine screws 11 screw-threaded into opposite ends of the outer casing section 4. The end caps 3 are formed to provide fluid outlet openings 12. Other openings 13 are provided in the end caps 3, these communicating with the ventilating opening 8 through various spaces in the end caps 3 and between the outer shell 4 and inner cylindrical section 5.

An elongated drive shaft 14 is journaled in bearing assemblies 15 mounted in the end caps 3 as are suitable end thrust bearings 16. One end of the shaft 14 is shown as terminating within one of the end caps 3, this end being concealed under a cover plate 17, see particularly FIG. 2. The opposite end portion of the shaft 14 projects outwardly through the opposite end cap 3 through a conventional dust seal 18, and is provided with a keyway 19. As shown, the shaft 14 extends axially of the casing 1, and is coaxial with the stationary internal gears formed by the gear teeth 9.

Figure 3:
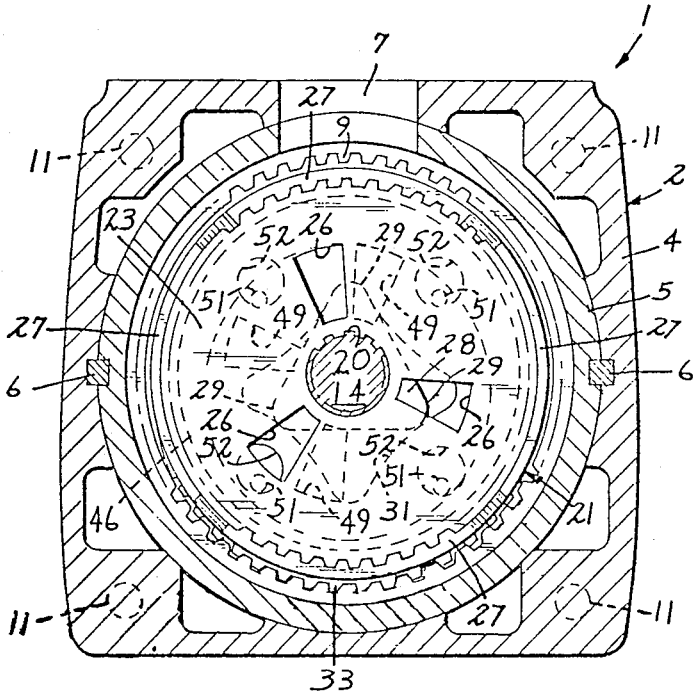
FIGS. 3, 4, 5, 6, and 7 are transverse sections taken on the lines 3—3, 4—4, 5—5, 6—6, and 7—7, respectively.
Figure 4:
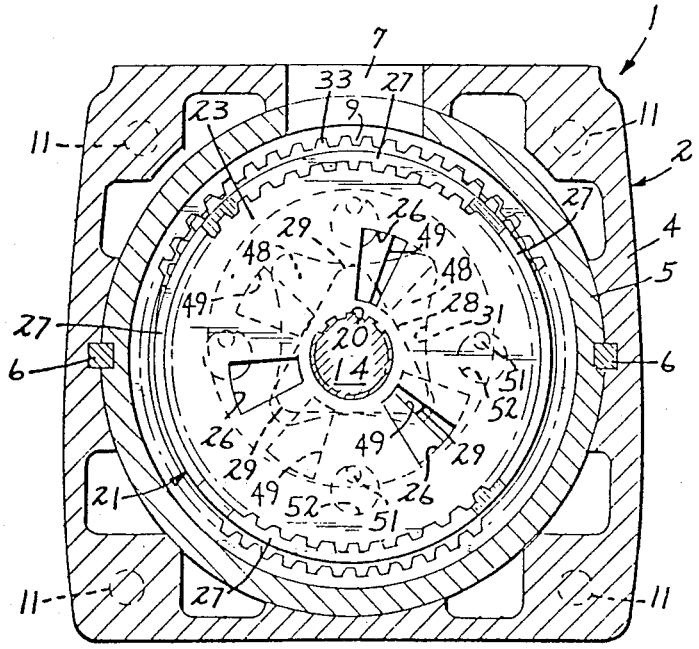
Figure 5:
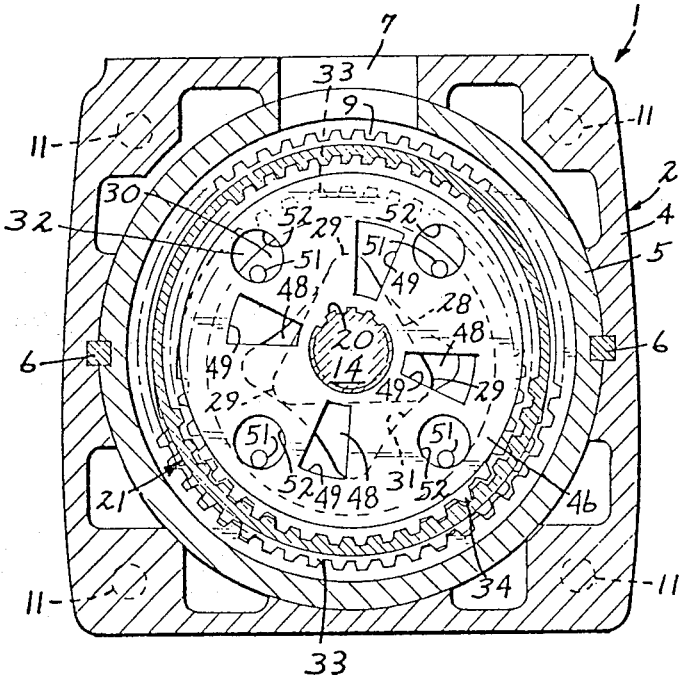
Figure 6:
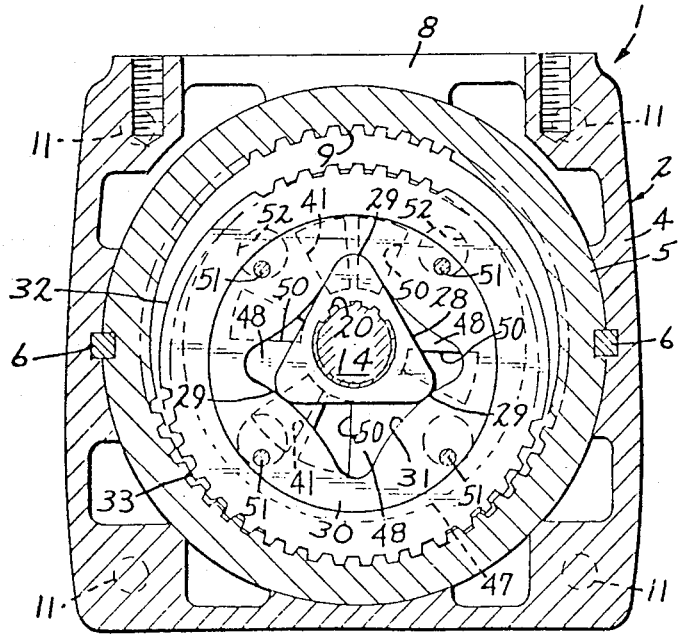
Figure 7:
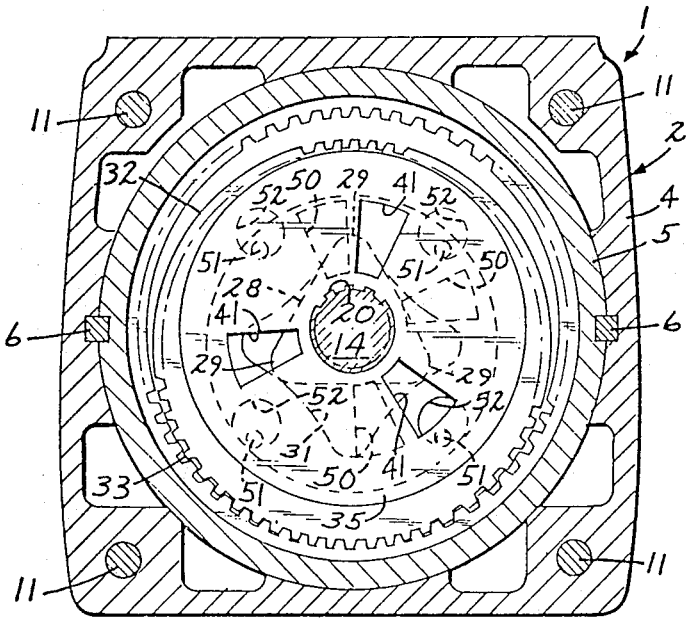

The shaft 14 is formed to provide a splined portion 20 axially inwardly of the bearings 15 for mounting of various elements for rotation with the shaft 14. A primary rotor, indicated generally at 21, comprises a cylindrical member 22, a pair of annular plates 23 and a tubular spacer 24 disposed between the annular plates 23. The annular plates 23 have axially opposite flat surfaces and, together with the tubular spacer are provided with axial splined openings closely fitting the splined portion 20 of the shaft 14. The outer marginal edges of the annular plates 23 are formed to provide gear teeth that have close meshing engagement with internal gear teeth 25 on the cylindrical member 22. As shown in FIGS. 2 - 4, the plates 23 are disposed in axially spaced relation to each other and are provided with a plurality of circumferentially spaced fluid passageways 26 therethrough. For the purpose of the present example, the passageways 26 are three in number in each annular plate 23. Intermediate the plates 23, the cylindrical member 22 is provided with circumferentially extending slots 27, these being disposed inwardly of the inner end of the inlet opening 7. In the assembled form of the primary rotor 21, the portions of the cylindrical member 22 axially outwardly of the plates 23 form annular flanges, the gears or gear teeth 25 thereof being hereinafter referred to as rotary internal gears 25. Each of the rotary internal gears 25 is disposed axially inwardly of a respective one of the stationary internal gears 9.

A pair of secondary rotors 28 are splined to the shaft 14 in axially outwardly spaced relationship each to a different one of the primary rotor plates 23, other tubular spacers 24 being interposed between the plates 23 and secondary rotors 28. In the form of the invention illustrated, the secondary rotors 28 are cross-sectionally in the form of equilateral triangles to define rounded external tooth elements 29. As shown particularly in FIGS. 3 – 6, the secondary rotors 28 are coaxial with the shaft 14. Each of the secondary rotors 28 has eccentrically mounted thereon one of pair of ring members 30 having internal tooth elements 31 that are one more in number than the tooth elements 29 of the secondary rotors 28. The ring members 30 are adapted to partake of orbital movement, with their axes moving in orbits around the common axis of the secondary rotors 28 and shaft 14. As shown FIGS. 2 – 4, one of the ring members 30 is disposed in angularly displaced relationship with respect to the other ring member 30, so that the axes of the ring members 30 are disposed at diametrically opposite sides of the common axis of the secondary rotors 28. In FIG. 2, the axis of one of the ring members is indicated at A, the axis of the other thereof being indicated at B. The common axis of the shaft 14 and secondary rotors 38 is indicated at C. The ring members 30 have outer cylindrical surfaces on which are journaled annular members 32, each of which is formed to provide axially spaced externally toothed gears 33 and 34 that have meshing engagement with respective ones of the internal gears 9 and 25. The annular members 32 are carried in common orbits with their respective ring members 30, the gears 33 and 34 being of substantially less diameter than their respective internal gears 9 and 25. The angularly displaced relationship between the ring members 30 causes the gears 33 and 34 of one of the annular members 32 to engage their respective internal gears 9 and 25 at a point diametrically opposite the point of engagement of corresponding teeth of the other annular member 32 with the other internal gears 9 and 25.

Figure 8:
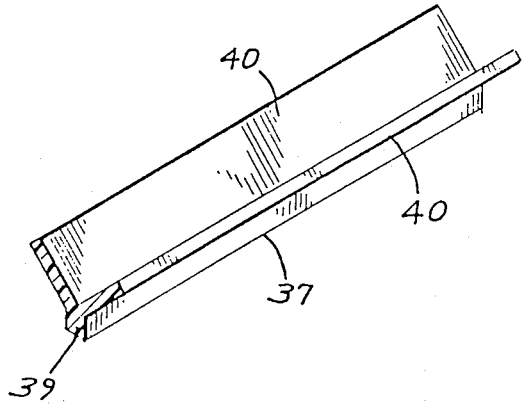
FIG. 8 is a fragmentary view partially in section and partly in perspective, of one of the sealing rings of FIGS. 2 and 7.

A pair of annular plate-like fluid transfer elements 35 are splined on the shaft 14 for common rotary movement therewith each axially inwardly of a different one of the sealing plates 10. Each of the plates 10 is formed to provide an annular groove 36 for reception of a sealing ring 37 preferably made of rubber or other elastomeric material and preferably backed by a commercially available O-ring 38. As shown in FIG. 8, the sealing ring 37 is preferably Y-shaped to provide an annular body portion 39 and diverging flanges 40, the body portion 39 being received in the groove 36, the flanges 40 being flattened between each fluid transfer element 35 and its adjacent sealing plate 10. Each fluid transfer element 35 is formed to provide a plurality of circumferentially spaced fluid passages 41. These are shown as being three in number. Each fluid transfer element is axially spaced from its adjacent secondary rotor 28 by a tubular spacer 24 splined to the shaft 14.

The shaft 14 is held against axial movement in the casing 1 by a pair of snap rings or collars 42 mounted in circumferential grooves 43 in the shaft 14 adjacent the axially inner ends of the bearings 15. The snap rings 42 further hold the rotors 21 and 28, as well as the fluid transfer plates 35 in their proper positions on the shaft 14, through the medium of a pair of loading collars 44 and a plurality of spring washers 45. The number of washers may be varied to compensate for variations in machining tolerances of the several parts.

Each of the secondary rotors 28 and its respective ring member 30 is provided with axially inner and outer annular valve discs 46 and 47, respectively, these being journaled on respective ones of the tubular spacers 24, axially opposite faces of the valve discs 46 slidably engaging adjacent sides of the annular rotor plates 23 and the inner ends of adjacent secondary rotors 28 and their respective ring members 30 and annular members 32. The axially opposite faces of the valve discs 47 are disposed in face to face sliding engagement with the adjacent fluid transfer elements 35 and the axially outer end surfaces of the secondary rotors 28, associated ring members 30 and annular members 32. The valve discs 46 and 47 cooperate with their respective rotors 28 and ring members 30 to define fluid chambers 48 that successively expand and contract during rotary movement of the shaft 14 and rotary and orbital movement of the ring members 30. Each of the valve discs 46 and 47 have a plurality of respective fluid passages 49 and 50 therethrough which move into and out of register with different ones of chambers 48 as well as into and out of register with different ones of the fluid passageways 26 and 41 in the primary rotor 21 and fluid transfer elements 35. In the present embodiment, the fluid passages 49 in each of their respective valve discs 46 and 47 are four in number.

Means for imparting rotary movement to the valve discs 46 and 47 responsive to orbital movement of the ring members 30 comprises a plurality of pins or shafts 51 that project axially outwardly from the ring members 30 and into circumferentially spaced openings 52 extending axially through the valve discs 46 and 47. The shafts or pins 51 partake of orbital movement in common with their respective ring members 30 within their respective valve disc openings 52, the relative diameters of the pins 51 and their respective openings 52 and the location of the openings 52 being such that the pins 51 have sliding engagement with the circular walls of the openings 52. Thus, the valve discs 46 and 47 partake of only rotary movement on the axis of the shaft 47, such movement being imparted to them by rotary movement of their respective ring members 30 during orbital movement thereof.

In the above described structure, the fluid passageways 41 in the fluid transfer element 35 communicate with the outlet openings 12 through annular passageways defined by the sealing plates 10 and their respective loading collars 44, as shown in FIG. 2. It will be appreciated that the device may be operated as a fluid motor or as a fluid pump, with equal facility. When operated as a motor, fluid, such as air under pressure, is introduced to the interior of the casing 1 through the inlet opening 7 from whence it flows radially inwardly through the slots 27 of the primary rotor 21 and axially outwardly through the passageways 26 and registering ones of the passageways 49 into given ones of the chambers 48, causing these chambers to expand by imparting orbital movement to the ring members 30. At the same time, air within the contracting ones of the chambers 48 is allowed to discharge through registering ones of the passageways 41 and 50 and outwardly through the outlet openings 12. During orbital movement of the ring members 30 and their respective annular members 32, engagement of the external gears 33 and 34 with their respective internal gears 9 and 25 causes rotation to be imparted to the primary rotor 21 and shaft 14. As the shaft 14 rotates, so also do the secondary rotors 28. The relative number and location of the passageways 26 and 49, as well as the gearing arrangement between the annular member 52 and rotor 21 causes one of the passageways 26 to be in register with a fluid passage 49 when the passage 49 is in register with an expanding one of the fluid chambers 48. At the same time, one of the fluid passages 41 is in register with a fluid passage 50 and in register with one of the contracting chambers 48 to permit discharge of air from the contracting chamber 48 to an adjacent group of the outlet openings 12.

It will be appreciated that the above-described rotary fluid displacement apparatus is capable of various modifications within the scope of the invention. For instance, one of the secondary rotors might be eliminated, together with its ring member 30 and annular member 32. Then, by closing the outlet openings 12 at that end of the casing 1 from which the above-mentioned elements are removed, the apparatus will operate with the use of the remaining secondary rotor 28 and its respective ring member 30 and annular member 32. Further, by removing the dust cap 17, a shaft similar to the shaft 14 but having its ends projecting axially outwardly from opposite ends of the casing 1, may be used. Still further, the inlet opening 7 may be closed and the outlet openings 12 at one end of the casing 1 used as an inlet, so that fluid is delivered to one of the secondary rotors 28, the primary rotor 21, and the other of the secondary rotors 28 in succession. The above, and still further modifications may be made without departure from the spirit and scope of the invention, as defined in the claims.

I claim:

1. A rotary fluid displacement apparatus comprising:

a. casing means defining fluid inlet and outlet openings and a stationary internal gear between said openings;

b. a shaft journaled in said casing means coaxial with said internal gear;

c. a primary rotor fixed on said shaft and including a rotary internal gear and defining fluid passages communicating with one of said openings;

d. a secondary rotor having external tooth elements and fixed on said shaft for rotation therewith in axially spaced relationship to said primary rotor;

e. a cooperating ring member emcompassing said secondary rotor eccentric therewith for rotary and orbital movements relative thereto wherein the axis thereof describes an orbit about the axis of said secondary rotor and said shaft, said ring member having internal tooth elements one more in number than the tooth elements of said secondary rotor, the tooth elements of said ring member and secondary rotor having substantially sealing engagement with each other and cooperating to define inner and outer walls of successively expanding and contracting fluid chambers during said rotary and orbital movement of the ring member;

f. an annular member journaled on said ring member concentric therewith and for common orbital movements therewith, said annular member defining a pair of axially spaced gears each having intermeshing engagement with a different one of said internal gears and describing an orbit within said internal gears in common with said ring member;

g. a fluid transfer element in said casing means defining fluid passages communicating with the other one of said openings in the casing means;

h. and valve means cooperating with said primary rotor and fluid transfer element for delivering fluid from said inlet opening to the expanding ones of said chambers and from the contracting chambers to said outlet openings.

2. The rotary fluid displacement apparatus defined in claim 1 in which said valve means comprises a pair of valve elements encompassing said shaft, characterized by means operatively connecting said valve elements to said ring member for imparting rotary movement to said valve elements responsive to rotary movement of said ring member during said orbital movement thereof.

3. The rotary fluid displacement apparatus defined in claim 2 in which said primary rotor comprises an annular plate-like portion and an annular flange at the outer marginal edge of said plate-like portion, said flange comprising said rotary internal gear, said first mentioned fluid passages extending through said plate-like portion in a direction axially of the primary rotor.

4. The rotary fluid displacement apparatus defined in claim 1 in which said fluid transfer element is fixed on said shaft for rotation therewith.

5. The rotary fluid displacement apparatus defined in claim 4 in which said valve means comprises a pair of valve discs at axially opposite ends of said ring member and in sliding engagement with said ring member and secondary rotor, each of said discs having sliding engagement with a different one of said primary rotor and said fluid transfer element, said discs having openings therethrough communicating with said fluid chambers and movable into and out of registration with the fluid passages in respective ones of said primary rotor and fluid transfer element.

6. The rotary fluid displacement apparatus defined in claim 5 in which said valve discs are journaled on said shaft, characterized by means operatively connecting said valve discs to said ring member for imparting rotary movement to said valve discs responsive to rotary movement of said ring member during said orbital movement thereof.

7. The rotary fluid displacement apparatus defined in claim 6 in which said means operatively connecting the valve discs to the ring member comprises a plurality of circumferentially spaced drive members projecting axially from opposite ends of the ring member, said valve discs having circumferentially spaced openings extending in an axial direction therethrough for reception of said drive members.

8. The rotary fluid displacement apparatus defined in claim 7 in which said drive members comprise rigid drive pins each having a diameter relative to the diameter of its respective valve disc opening so that the axis of each of said openings moves in an orbit about the axis of its respective drive pin and equal in diameter to the orbit traveled by the axis of said ring gear.

9. A rotary fluid displacement apparatus comprising:

a. elongated casing means defining intermediate fluid opening means intermediate its ends and end opening means at the opposite ends of the casing means, said casing means defining a pair of longitudinally spaced coaxial stationary internal gears between said intermediate opening means and said end opening means;

b. a rotary shaft;

c. bearing means journaling said shaft in said casing means coaxial with said internal gears;

d. a primary rotor fixed on said shaft and including a pair of axially spaced rotary internal gears disposed intermediate said stationary gears, said primary rotor defining fluid passages in communication with said intermediate opening;

e. a pair of secondary rotors each having axially inner and outer ends and external tooth elements, each of said secondary rotors being fixed on said shaft axially outwardly of an axially opposite side of said primary rotor;

f. a pair of cooperating ring members each encompassing a different one of said secondary rotors eccentric therewith for rotary and orbital movements relative thereto wherein the axes of the ring members describe orbits about the axes of their respective secondary rotors, each of said ring members having internal tooth elements one more in number than the tooth elements of its respective secondary rotor, the tooth elements of said ring members and their respective secondary rotors having substantially sealing engagement with each other and cooperating to define the inner and outer walls of successively expanding and contracting fluid chambers during said orbital and rotary movement of the ring members;

g. a pair of annular members each journaled on a different one of said ring members concentric therewith and for common orbital movements therewith, each of said annular members defining a pair of axially spaced gears having intermeshing engagement each with a different one of said stationary and rotary internal gears, said annular members describing orbits within their respective internal gears in common with their respective ring members;

h. a pair of fluid transfer elements in said casing means each disposed intermediate a different one of said secondary rotors and an adjacent one of the ends of said casing means, said transfer elements each having fluid passages therethrough communicating with the fluid opening in the adjacent end of the casing means;

i. and valve means cooperating with said primary rotor and said fluid transfer elements for delivering fluid from one of said opening means to the expanding ones of said chambers and from the contracting chambers to the other opening means.

10. The rotary fluid displacement apparatus defined in claim 9 in which the internal tooth elements of one of said ring members are angularly displaced with respect to the internal tooth elements of the other ring member, whereby the axes of said ring members are disposed at diametrically opposite sides of the axis of said shaft.

11. The rotary fluid displacement apparatus defined in claim 9 in which said primary rotor defines axially opposite flat annular surfaces and includes annular flanges projecting axially outwardly from said annular surfaces and defining said rotary internal gears, said valve means comprising inner annular valve plates between said surfaces and said secondary rotors and in face to face sliding engagement with said surfaces and the inner ends of said secondary rotors and their respective ring members, and outer annular valve discs between and in face to face sliding engagement with the outer ends of said secondary rotors and said transfer elements, said valve discs having fluid passages extending axially therethrough, and means for imparting rotation to said valve discs.

12. The rotary fluid displacement apparatus defined in claim 11 in which said intermediate opening means is a fluid inlet opening, said primary rotor being disposed inwardly of said inlet opening, the fluid passages in said primary rotor including portions opening radially toward said inlet opening and other portions moving into and out of register with the valve passages in said inner valve discs during relative rotation between said primary rotor and inner valve discs, the fluid passages in said transfer elements moving into and out of registration with the fluid passages in said outer valve discs during relative rotation therebetween.

* * * * *